US006037050A

United States Patent [19]

Saito et al.

[11] Patent Number: 6,037,050

[45] Date of Patent: Mar. 14, 2000

[54] INK-JET RECORDING SHEET

[75] Inventors: Yoichi Saito; Masaru Tsuchiya; Yoshihiro Mochizuki, all of Hino, Japan

[73] Assignee: Konica Corporation, Tokyo, Japan

[21] Appl. No.: 08/953,620

[22] Filed: Oct. 17, 1997

[30] Foreign Application Priority Data

Oct. 25, 1996 [JP] Japan ..... 8-283635

[51] Int. Cl.[7] ..... B41M 5/00

[52] U.S. Cl. ..... 428/304.4; 428/195; 428/323; 428/331; 428/341; 428/342; 428/522

[58] Field of Search ..... 428/195, 520, 428/331, 304.4, 341, 342, 323, 522

[56] References Cited

U.S. PATENT DOCUMENTS

| | | | |
|---|---|---|---|
| 4,592,951 | 6/1986 | Viola | 428/331 |
| 4,783,376 | 11/1988 | Sakaki et al. | 428/511 |
| 5,141,797 | 8/1992 | Wheeler | 428/195 |
| 5,662,997 | 9/1997 | Onishi et al. | 428/331 |

*Primary Examiner*—Pamela R. Schwartz
*Attorney, Agent, or Firm*—Frishauf, Holtz, Goodman, Langer & Chick, P.C.

[57] ABSTRACT

An ink-jet recording sheet comprises a support, and provided thereon, a void layer containing fine inorganic particles and a hydrophilic binder, the hydrophilic binder having being cross-linked by a hardener.

20 Claims, No Drawings

INK-JET RECORDING SHEET

FILED OF THE INVENTION

The present invention relates to a recording sheet for ink-jet recording, and particularly to a recording sheet comprising a void layer with a high void volume having high ink absorption property and minimizing layer brittleness.

BACKGROUND OF TRE INVENTION

Ink jet recording records an image or text on a recording sheet such as a paper sheet, applying various principles. This recording method has advantages in providing a relatively high speed recording, low noise and easy color image formation. There have been problems in maintenance or ink clogging of nozzles in this method, but improvements have been made in ink and device, and this method has been widely applied to various fields such as printers, facsimile and computer terminals.

It is required for ink recording sheet to provide printing dots with high density and bright image tone, to provide rapid ink absorption property producing no ink diffusion or blur in overlapped printing dots, and to provide printing dots with smooth periphery and no blurring in which printing ink is not so greatly diffused.

In the recording sheet slow in ink absorption, two or more kinds of color ink drops repel one another at overlapped ink recording portions on the sheet, resulting in image unevenness, or different color inks at different but nearest ink recording portions on the sheet are diffused and mixed, resulting in deterioration of image quality. Therefore, a recording sheet having high ink absorption property is eagerly sought.

Many techniques have been proposed in order to solve the above described problems.

There have been proposed, for example, an ink jet recording sheet paper of low size content wetted with surface treatment coating disclosed in Japanese Patent O.P.I. Publication No. 52-53012, an ink jet recording sheet paper comprising a support and provided thereon, an ink absorption layer disclosed in Japanese Patent O.P.I. Publication No. 55-5830, an ink jet recording sheet paper comprising a layer containing non-colloidal silica powder as pigment disclosed in Japanese Patent O.P.I. Publication No. 56-157, an ink jet recording sheet paper comprising an inorganic and organic pigment disclosed in Japanese Patent O.P.I. Publication No. 57-107878, an ink jet recording sheet paper comprising two void distribution peaks disclosed in Japanese Patent O.P.I. Publication No. 58-110287, an ink jet recording sheet paper comprising two upper and lower porous layers disclosed in Japanese Patent O.P.I. Publication No. 62-111782, an ink jet recording sheet paper comprising amorphous cracks disclosed in Japanese Patent O.P.I. Publication Nos. 59-68292, 59-123696 and 60-18383, an ink jet recording sheet paper comprising a fine powder layer disclosed in Japanese Patent O.P.I. Publication Nos. 61-135786, 61-148092 and 62-149475, an ink jet recording sheet paper comprising pigments or fine particle silica each having a specific physical property disclosed in Japanese Patent O.P.I. Publication Nos. 63-252779, 1-108083, 2-136279, 3-65376 and 3-27976, an ink jet recording sheet paper comprising fine particle silica such as colloidal silica disclosed in Japanese Patent O.P.I. Publication Nos. 57-14091, 60-219083, 60-210984, 61-20797, 61-188183, 5-278324, 6-92011, 6-183134, 7-137431 and 7-276789, or an ink jet recording sheet paper comprising hydrated alumina fine particles disclosed in Japanese Patent O.P.I. Publication Nos. 2-276671, 3-67684, 3-215082, 3-251488, 4-67986, 4-263983 and 5-16517.

The above described methods absorb a recording ink in a layer (void layer) having voids, but the void layer does not almost swell during ink absorption. When the void layer absorbs ink, the ink amount is necessarily restricted by the layer thickness itself.

When the void layer of an ink jet recording sheet has a dry thickness of 40 $\mu$m, and the solid packed layer is assumed to have a dry thickness of 22 $\mu$m, the void layer has a void volume of only 18 ml (40–22) per $m^2$ of the ink recording sheet. Although depending on recording methods, ink absorption volume may not be sufficient when a maximum ink amount is supplied. When ink absorption volume is insufficient, ink oozes on the recording sheet surface, so that a clear image cannot be obtained.

In order to obtain a void layer with a high void volume, a method of increasing the coating thickness is most effective, but this is disadvantageous not only in a cost increase in its manufacture, but also in curl occurrence or layer brittleness (particularly crack occurrence at low temperature storage or poor layer adhesion to the support) due to coating amount increase.

It is preferable that the void layer has the lowest possible content of a solid component such as a binder, the largest possible void volume, and the least possible dry thickness.

A typical method of increasing the void volume in a void layer is to increase a fine inorganic particle content relative to a hydrophilic binder content in the void layer, and to contain no other components in the void layer, however, in this method there is a problem in that the layer is extremely brittle.

The brittle void layer is likely to separate from the support of an ink jet recording sheet during its handling, during its feeding in an ink jet printer or during its transporting in the ink jet printer, or fine cracks occur on the layer, resulting in a serious problem that the recording ink diffuses along the cracks.

There are various ink jet recording sheets in which an ink absorbing layer without voids absorbs and retains ink due to swelling of the binder contained in the layer. For example, there are known ink jet recording sheets obtained by coating a hydrophilic binder such as gelatin, casein, starch, alginic acid, polyvinyl alcohol, polyvinyl pyrrolidone, polyethylene oxide, polypropylene oxide, carboxymethyl cellulose, hydroxyethyl cellulose, dextran or pullulan on a support.

These ink jet recording sheets have advantages in providing a clear image with high glossiness and high density and in receiving ink by swelling due to ink of the binder used to give high ink absorption. However, the ink jet recording sheets are inferior in ink absorption speed as compared to ink jet recording sheets comprising a void layer, and the former has a disadvantage in that when a large amount of ink is jetted onto the sheet, ink drops repel one another, resulting in blurring.

SUMMARY OF THE INVENTION

The present invention has been made in view of the above.

An object of the invention is to provide an ink jet recording sheet, comprising a void layer with high ink absorption property containing a minimum amount of solid fine particles dispersed in a hydrophilic binder.

DETAILED DESCRIPTION OF THE INVENTION

The above object of the invention can be attained by the followings:

1. An ink-jet recording sheet comprising a support, and provided thereon, a void layer containing flocculated fine inorganic particles and a hydrophilic binder, the hydrophilic binder being cross-linked with a hardener, 2. the ink-jet recording sheet of item 1 above, wherein the hydrophilic binder is polyvinyl alcohol or cation-modified polyvinyl alcohol, 3. the ink-jet recording sheet of item 2 above, wherein the polyvinyl alcohol or cation-modified polyvinyl alcohol has an average polymerization degree of 1,000 or more, 4. the ink-jet recording sheet of item 1, 2 or 3 above, wherein the fine inorganic particles have an average primary order particle size of 0.003 to 0.05 μm, 5. the ink-jet recording sheet of item 1, 2, 3 or 4 above, wherein the hardener is boric acid or its salt or a polyepoxy compound, or 6. the ink-jet recording sheet of item 1, 2, 3, 4 or 5 above, wherein the void layer contains a polyol with a molecular weight of not more than 300 having at least two hydroxy groups in the molecules.

The present invention will be detailed below.

The void layer of the ink jet recording sheet of the invention comprises a hydrophilic binder and flocculated fine inorganic particles.

Methods of forming voids in a layer are well known, and include (1) a method of coating a coating solution containing at least two kinds of polymers on a support and then causing phase separation of these polymers during drying to form voids, (2) a method of coating a coating solution containing solid fine particles and a hydrophilic or hydrophobic binder on a support, drying to obtain an ink jet recording sheet, and then immersing the sheet in water or an organic solvent to form voids, (3) a method of coating a coating solution containing a compound capable of foaming during layer formation on a support, and then foaming the compound during drying to form voids, (4) a method of coating a coating solution containing porous fine particles and a hydrophilic binder on a support to form voids in or between the porous fine particles, (5) a method of coating a coating solution containing a hydrophilic binder and solid fine particles or fine oil drops in an amount by volume identical to or more than the hydrophilic binder on a support to form voids between the solid fine particles, and (6) a method used in the invention of preparing a coating solution containing fine inorganic particles having an average particle size of 0.1 μm or less, and coating the solution on a support wherein the fine inorganic particles are flocculated to form a secondary order particle or a three dimensional structure during preparation of the coating solution or during the coating process to form voids.

In the invention, of the above void forming methods, method (6) producing flocculated fine inorganic particles is employed in view of high glossiness, high void rate to layer thickness and storage stability of the void structure.

The term "flocculated" herein referred to implies that a hydrogen bond is formed between a functional group on the surface of the fine inorganic particles and a functional group of the hydrophilic binder to form a flocculated structure. The functional group on the surface of the fine inorganic particles capable of forming a hydrogen bond is preferably a hydroxy group. The functional group of the hydrophilic binder is preferably a group having an oxygen atom, and more preferably a hydroxy group.

The void layer formed through the flocculated structure in the invention is preferably formed by flocculated primary order fine inorganic particles in a dispersion form in a dispersion containing an aqueous hydrophilic binder solution, in which the particles are flocculated with relatively limited contacting portions.

The flocculated structure includes one in which the flocculated particles in a straight-chained or branched form are dispersed in an aqueous solution or one in which flocculated particles are further flocculated to form a three dimensional structure in the solution. In either structure, these solutions are coated on a support and dried to form minute voids in the coated layer.

The size of the voids formed in the void layer is from about the size of the primary order particles to several times their size.

The method for forming such a flocculated structure includes a method of producing the flocculated structure by adding a hydrophilic polymer for accelerating flocculation in a slight amount to the aqueous hydrophilic binder solution containing primary order particles, in which the primary order particles are stably dispersed and not flocculated, or a method of producing the flocculated structure by adding a water soluble binder to the aqueous solution containing primary order particles wherein the binder can weakly bond with the particle surface.

The latter method is preferable in this invention, in that the void volume is relatively easy to control, the voids are produced more stably, a larger amount of voids are produced as compared to the amount of fine particles used, and the void layer formed has higher glossiness.

It is preferable in the latter method that primary order particles with an average primary order particle size of preferably 0.003 to 0.05 μm, and more preferably 0.005 to 0.05 μm are used in view of high glossiness. The average primary order particle size is more preferably 0.004 to 0.02 μm.

The inorganic fine particles in the invention include silica, silicate such as calcium silicate or magnesium silicate, aluminum hydroxide, and various smectites clay such as synthetic hectorite (disclosed, for example in Japanese Patent O.P.I. Publication Nos. 7-81210 and 6-184998).

The void layer of the ink-jet recording sheet of the invention contains the fine inorganic particles in an amount of 1 g to 30 g/m$^2$, and preferably 5 g to 20 g/m$^2$.

In the invention, preferably fine silica particles in primary order particle form and polyvinyl alcohol or modified polyvinyl alcohol as a hydrophilic binder are used, wherein a weak hydrogen bond is formed between a silanol group on the silica surface and a hydroxy group of the polyvinyl alcohol to form a flocculate.

The fine silica particles in primary order particle form have an average particle size of preferably not more than 0.02 μm, and more preferably 0.015 to 0.006 μm. The fine silica particles in secondary order particle form, in which the particles in primary order particle form are combined, have an average particle size of preferably 0.02 to 0.2 μm, and more preferably 0.03 to 0.1 μm.

The fine silica particles were preferably synthesized by a synthetic method called a gas phase reaction.

The hydrophilic binder referred to in the invention is a natural or synthetic polymer having a solubility in water of 0.1 weight % or more at room temperature and having an average molecular weight of 10,000 or more.

The hydrophilic binder includes gelatin or its derivative, polyvinyl pyrrolidone (having an average molecular weight of preferably about 200,000 or more), pullulan, polyvinyl alcohol or its derivative (having an average molecular weight of preferably about 20,000 or more), polyethylene glycol (having an average molecular weight of about 100,000 or more), carboxymethyl cellulose, hydroxyethyl cellulose, dextrane, dextrin, polyacrylic acid or its salt, agar, κ-carrageenin, λ-carrageenin, τ-carrageenin, xanthene gum, alginic acid, gum arabic, polyalkyleneoxide copolymers disclosed in Japanese Patent O.P.I. Publication Nos. 7-195826 and 7-9757, a water-soluble polyvinyl butyral, and a homopolymer or copolymer obtained by polymerizing a vinyl monomer having a carboxy group or a sulfonic acid group disclosed I Japanese Patent O.P.I. Publication No. 62-245260. These hydrophilic binders may be used singly or in combination.

The hydrophilic binder is especially preferably polyvinyl alcohol or cation-modified polyvinyl alcohol.

The void layer of the ink-jet recording sheet of the invention contains the hydrophilic binder in an amount of 0.2 g to 10 g/m$^2$, and preferably 0.5 g to 5 g/m$^2$.

The polyvinyl alcohol has an average polymerization degree of preferably 300–4,000, and more preferably 1,000 to 4,000 in view of layer strength. The polyvinyl alcohol has a saponification degree of preferably 70 to 100 mol %, and more preferably 80 to 100 mol %. The cation-modified polyvinyl alcohol is obtained by saponificating a copolymer of vinyl acetate and an ethylenically unsaturated monomer having a cationic group.

The ethylenically unsaturated monomer having a cationic group includes tri-methyl-(2-acrylamide-2,2-dimethylethyl) ammonim chloride, tri-methyl-(3-acrylamide-3,3-dimethylpropyl)ammonim chloride, N-vinylimidazole, N-vinyl-2-methylimidazole, N-(3-dimethylaminopropyl) methacrylamide, tri -methyl-(methacrylamidopropyl) ammonim chloride, and N-(1,1-dimethyl-3-dimethylaminopropyl)acrylamide.

The content of the monomer having a cationic group in the cation-modified polyvinyl alcohol is preferably 0.1 to 10 mol %, more preferably 0.2 to 5 mol %, based on the vinyl acetate content. The cation-modified polyvinyl alcohol has an average polymerization degree of ordinarily 500 to 4,000, preferably 1,000 to 4,000. The saponification degree of the cation-modified polyvinyl alcohol is ordinarily 60 to 100 mol %, and preferably 70 to 99 mol %.

The hydrophilic polymer especially preferable to form a flocculated structure in the invention is polyvinyl alcohol.

The content ratio by weight of the hydrophilic binder to the inorganic fine particles in the void layer in the invention is 1:15 to 1:1, and preferably 1:10 to 1:2.

The exemplified method forming a layer containing a flocculate of polyvinyl alcohol and fine silica particles will be explained below.

A (5 to 15 weight %) silica fine particle dispersion solution is gradually added with vigorous stirring to a (3 to 15 weight %) aqueous polyvinyl alcohol solution with a pH of 6 to 8 at 40° C., and then dispersed with an ultrasonic disperser or a high-speed homogenizer. In this process, various surfactants or a water miscible organic solvent such as methanol, acetone or ethyl acetate are preferably employed in that an uniform layer coating solution is obtained.

Thereafter, various additives are added, adjusted to have a viscosity necessary to coat, coated on a support according to a conventional coating method and dried to obtain the above described layer having voids.

It is necessary in the invention that the hydrophilic binder used is cross-linked by a hardener to obtain a high void ratio without lowering the layer strength.

The hardener is a compound having a group capable of reacting with the hydrophilic binder or a compound capable of accelerating reaction between the different groups which the hydrophilic binder has. The hardeners are selected depending upon kinds of hydrophilic binders used.

The hardeners include epoxy type hardeners (for example, diglycidylethyl ether, ethylene glycol diglycidylethyl ether, 1,4-butanediol diglycidylethyl ether, 1,4-diglycidylcyclohexane, N,N-diglycidyl-4-glycidyloxyaniline, sorbitolpolyglycidyl ethers glycerolpolyglycidyl), aldehyde type hardeners (for example, formaldehyde, glyoxal), active halogen type hardeners (for example, 2,4-dichloro-4-hydroxy-1,3,5-s-triazine), active vinyl type hardeners (for example, 1,3,5-trisacryloyl-hexahydro-s-triazine, bisvinylsulfonyl methyl ether), boric acid or its salt, borax, and alum. r When polyvinyl alcohol or cation-modified polyvinyl alcohol is used as the especially preferable hydrophilic binder, boric acid or its salt or epoxy type hardeners are preferably used as a hardener.

The most preferably hardener is boric acid or its salt.

The boric acid or its salt in the invention is an oxygen acid of boron or its salt, and its example includes orthoboric acid, diboric acid, metaboric acid, tetraboric acid, pentaboric acid, octaboric acid and their salts.

The amount of the hardeners is varied depending on kinds of binders used, kinds of hardeners used, kinds of fine inorganic particles or the content ratio of the inorganic particles to hydrophilic binders used, but it is ordinarily 1 to 200 mg, and preferably 5 to 100 mg per g of hydrophilic binders used.

The hardeners are added to a void layer coating solution or a coating solution for forming another layer adjacent to the void layer at the time when the solutions are coated. The void layer coating solution is further coated on a layer containing a hardener on a support or the void layer coating solution is coated on a support, dried and the hardener containing solution is then overcoated on the dried layer to form a hardener containing void layer. It is preferable in the invention that the hardeners are added to a void layer coating solution or a coating solution for forming another layer adjacent to the void layer at the time when the solutions are coated, and the resulting solutions are coated on a support to form a void layer.

In the preferable method of forming a void layer, which preferably contains polyvinyl alcohol or super fine silica particles, a hardener is added to a void layer coating solution, allowed to stand for a specific time (preferably 10 minutes or more, more preferably 30 minutes or more), and coated on a support and dried to form a void layer having higher void rate with no layer strength deterioration.

In the ink jet recording sheet of the invention, the void layer preferably contains a polyol having in its molecular structure at least two hydroxy groups and having a molecular weight of not more than 300 in that a void layer with further enhanced layer strength is obtained.

The polyol includes ethylene glycol, diethylene glycol, polyethylene glycol having a molecular weight of 300 or less, glycerin, butanediol, butanetriol, and triethanol amine.

The polyol content of the void layer is preferably 0.02 to 2 g, and more preferably 0.05 to 1 g based on 1 g of the hydrophilic binder.

The effect of the invention markedly appears in the ink jet recording method employing an ink jet recording sheet with a maximum ink amount to be supplied thereto being 20 $ml/m^2$.

The void volume of the void layer in the invention is preferably 90% or more, and more preferably 95% or more, of the maximum ink amount to be supplied. The dry thickness of the void layer is preferably 15 to 50 $\mu$m, more preferably 20 to 50 $\mu$m, in that layer cracks do not produce and physical property of the layer is not deteriorated.

The void volume of the void layer in the invention is preferably 30 to 70 volume %, and more preferably 40 to 70 volume % of the total void layer volume in view of physical strength of the layer.

The void volume of the void layer in the invention is preferably 13 to 30 $ml/m^2$ as a void volume satisfying the above-described void volume.

The void layer in the invention or another layer optionally provided may contain various additives other than the above described compounds.

The additives include polystyrene, polyacrylates, polymethacrylates, polyacrylamides, polyethylene, polypropylene, polyvinyl chloride, polyvinylidene chloride, or their copolymers, organic latexes such as a urea resin and a melamine resin, oil drops such as liquid paraffin, dioctyl phthalate, tricresyl phosphate and silicone oil, various surfactants such as an anionic, cationic and nonionic surfactants, a UV absorbent disclosed in Japanese Patent O.P.I.

Publication Nos. 57-74193, 57-87988 and 62-261476, an anti-fading agent disclosed in Japanese Patent O.P.I. Publication Nos. 57-74193, 57-87988, 60-72785, 61-146591, 1-95091 and 3- 13376, a fluorescent brightening agent, a pH adjusting agent such as sulfuric acid, phosphoric acid, citric acid, sodium hydroxide, potassium hydroxide or potassium carbonate, an anti-forming agent, an anti-septic agent, a thickner, an anti-static agent and a matting agent disclosed in Japanese Patent O.P.I. Publication Nos. 59-42993, 59-52689, 62-280069, 61-24287 and 4-219266.

The layer on the ink recording surface side of the support in the ink jet recording sheet of the invention may contain, as a water resistant agent, a polycationic electrolyte disclosed in Japanese Patent O.P.I. Publication No. 56-84992, a polyarylamine disclosed in Japanese Patent Publication No. 4-15744 and Japanese Patent O.P.I. Publication Nos. 61-58788 and 62-174184 or an alkali metal salt of a weak acid disclosed in Japanese Patent O.P.I. Publication No 61-47290.

The void layer may be comprised of two void layers, and the two may be different as long as the layers are within the scope above described.

The support used in the ink jet recording sheet of the invention includes well-known, conventional supports for a ink jet recording sheet. The support is preferably a hydrophobic support into which ink does not permeate in that an image with sharpness and high density is obtained.

A transparent support in the invention includes a resin film or plate such as a polyester resin, a polyester resin, a diacetate resin, a triacetate resin, an acryl resin, a polycarbonate resin, a polyvinyl chloride resin, a polyimide resin, cellophane or celluloid and a glass plate. The support is preferably a heat resistant film, when used for an over-head projector, and especially preferably a polyethylene terephthalate film. The thickness of the transparent support is preferably about 10 to 200 $\mu$m. A subbing layer is preferably provided on a void layer side of a support or on a backing layer side of the support opposite the void layer in view of adhesion of the void layer or the backing layer to the support.

A translucent support is preferably a resin-coat paper (so-called RC paper) in which a polyolefin resin containing white pigment is provided at least one surface of a base paper sheet or a polyethylene terephthalate sheet (so-called white PET) containing white pigment.

In order to increase adhesion between a support and the void layer, the support is preferably subjected to corona discharge treatment or subbing treatment before the ink receiving layer coating. The ink jet recording sheet of the invention need not be colorless, and may be colored.

In the ink jet recording sheet of the invention, the support is preferably a base paper both surfaces of which are laminated with polyethylene in that a high quality image close to a photographic image is obtained at low cost. The polyethylene laminated paper will be explained below.

The base paper used in a support is papered employing a tree pulp with optional addition of a synthetic pulp such as polypropylene or a synthetic fiber such as nylon or polyester. The tree pulp includes LBKP, LBSP, NBKP, NBSP, LDP, NDP, LUKP, and NUKP. It is preferable that LBKP, NBSP, LBSP, NDP, LDP, or LUKP is used in a larger amount. The content of LBSP or LDP in the paper is preferably 10 to 70 weight %.

The above pulp is preferably a chemical pulp with less impurities (for example, sulfate of pulp or sulfite of pulp). The pulp bleached and increasing whiteness is useful., and The base paper optionally contains a sizing agent such as higher fatty acid, an alkyl ketene diner, white pigment such as calcium carbonate, talc, or titanium oxide, a paper strength increasing agent such as starch, polyacrylamide or polyvinyl alcohol, a fluorescent brightening agent, a moisture retaining agent such as polyethylene glycol, a dispersing agent, a softening agent such as a quaternary ammonium.

The freeness of the pulp is preferably 200 to 500 cc according to a CSF method, and the pulp fiber after beating has a total amount of pulp fiber remained on the 24 mesh and 42 mesh sieves of preferably 30 to 70 weight % according to JIS-P-8207. The pulp fiber has an amount of fiber remained on the 4 mesh sieve of preferably 20 weight % or less.

The weight of the base paper is preferably 30 to 250 g, and more preferably 50 to 200 g. The thickness of the paper is preferably 40 to 250 $\mu$m.

The base paper can be subjected to calender treatment during of or after papering to give high smoothness. The density of the base paper is generally 0.7 to 1.2 $g/m^2$ (JIS-P-8118). The stiffness of the base paper is preferably 20 to 200 g under the conditions according to JIS-P-8143.

The surface sizing agent may be coated on the surface of the paper, and the surface sizing agent includes those as described above which can be incorporated in the paper.

The pH of the paper is preferably 5 to 9 according to a hot water extracting method as defined in JIS-P-8113. The polyethylene with which both surfaces of the paper are laminated is mainly a low density polyethylene (LDPE) and/or a high density polyethylene (HDPE), but may be LLDPE or polypropylene.

The polyethylene on the void layer side is preferably a polyethylene containing rutile or anatase type titanium oxide, whereby whiteness and translucency of the support are improved, as used in a photographic print paper. The titanium oxide content of the polyethylene is about 3 to 20 weight %, and preferably 4 to 13 weight %.

The polyethylene laminated paper may be a glossy paper, or a matted or silk finish paper as used in a photographic print paper. When the base paper is laminated with a polyethylene film according to a melt-extruding method, the surface of the polyethylene film is matted or silk finished by molding to obtain a matted or silk finish paper.

The amount of polyethylene laminated on the base paper is determined to be optimize curl of an ink jet recording sheet under high or low humidity after coating the void layer and the backing layer, but the thickness of the polyethylene on the void layer side is generally 20 to 40 $\mu$m, and the thickness of the polyethylene on the backing layer side is generally 10 to 30 $\mu$m.

The above polyethylene laminated support preferably has the following properties:

(1) Tensile strength is preferably 2 to 30 kg in the mechanical direction, and 1 to 20 kg in the transverse direction according to JIS-P-8113.

(2) Tearing strength is preferably 10 to 200 g in the mechanical direction, and 20 to 200 g in the transverse direction according to JIS-P-8116.

(3) Compression elastic modulus$\geqq 10^3$ kgf/cm$^2$ (4) Bekk smoothness of the surface is preferably 20 seconds or more, and more preferably 500 seconds or more according to JIS-P-8119. The silk surface may have a smoothness not more than 20 seconds.

(5) Translucency is preferably 85% or more, and more preferably 90% or more according to JIS-P-8138.

In the manufacture of the ink jet recording sheet of the invention, a method of coating a void layer or optionally another hydrophilic layer such as a backing layer on a support can be selected from the conventional ones. The preferable method is a method in which various coating solutions are coated on a support and dried. The two or more layers can be simultaneously coated and especially preferably, all the hydrophilic layers are simultaneously coated.

The coating method includes a roller coating method, a rod-bar coating method, an air-knife coating method, a spray coating method, a curtain coating method and an extrusion coating method using a hopper disclosed in U.S. Pat. No. 2,681,294.

An image is recorded on the ink jet recording sheet of the invention employing a water based ink.

The water based ink herein referred to is a recording liquid comprising the following colorants, solvents and other additives. The colorant includes a direct dye, an acid dye, a basic die, a reactive dye and food dyes, each being well known in the art.

The solvent for water based ink includes water and a water soluble organic solvent, for example, alcohols such as methyl alcohol, isopropyl alcohol, n-butyl alcohol, tert-butyl alcohol and iso-butyl alcohol, amides such as dimethylformamide and dimethylacetoamide, ketones or ketonealcohols such as acetone and diacetone alcohol, ethers such as tetrahydrofurane and dioxane, polyalkylene glycols such as polyethylene glycol and polypropylene glycol, polyhydric alcohols such as ethylene glycol, propylene glycol, butylene glycol, triethylene glycol, 1,3,6-hexane triol, thiodiglycol, hexylene glycol, diethylene glycol, glycerin and triethanol amine and polyhydric alcohol lower alkyl ethers such as ethylene glycol methylether, diethylene glycol methyl(or ethyl)ether and triethylene glycol monobutylether.

Of these, polyhydric alcohols such as diethylene glycol, glycerin and triethanol amine or polyhydric alcohol lower alkyl ethers such as triethylene glycol monobutylether is preferable.

The other additives include a pH adjusting agent, a metal chelating agent, an anti-fungal, a viscosity adjusting agent, a surface tension adjusting agent, a wetting agent, a surfactant and an anti-rust agent.

The water based ink has a surface tension at 20° C. of preferably 25 to 50 dyn/cm, and more preferably 30 to 40 dyn/cm.

EXAMPLES

The invention will be detailed in the following examples, but the invention is not limited thereto. In the examples, "%" represents weight %, unless otherwise specified. The addition amount represents amount per m$^2$ of ink jet recording sheet.

Example 1

In 1000 ml of pure water 160 g of super fine silica particles with an anionic surface having an average particle size of about 0.07 $\mu$m were incorporated and dispersed by means of a high-speed homogenizer to obtain a silica dispersion (I). To the resulting dispersion 1600 ml of an aqueous 5% polyvinyl alcohol solution (II) containing surfactant-1 in an amount of 0.3 weight % were gradually added and dispersed by means of a high-speed homogenizer to obtain a translucent coating solution. The polyvinyl alcohol had an average polymerization degree of 1700 and a saponification degree of 90 mol %.

The above obtained coating solution was coated on a 170 g/m$^2$ paper support, both surfaces of a base paper being laminated with a polyethylene film, to give a wet thickness of 150 $\mu$m, and dried by air of 20 to 40° C. to give a void layer having a dry thickness of 20 $\mu$m. Thus, Ink Jet Recording Sheet Sample 1 (Comparative sample) was obtained. The paper support had a thickness of 240 $\mu$m, in which a polyethylene film containing anatase type titanium dioxide in an amount of 7 weight % was coated on the surface of a base paper on the ink recording layer side.

Surfactant-1

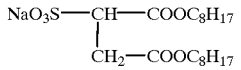

Ink jet recording sheet samples 2 through 9 were prepared in the same manner as in Ink Jet Recording Sheet Sample 1 as follows:

Ink Jet Recording Sheet Sample 2

Ink Jet Recording Sheet Sample 2 was prepared in the same manner as in Ink Jet Recording Sheet Sample 1, except that a mixture solution of 800 ml of polyvinyl alcohol solution (II) and 800 ml of an aqueous 0.3 weight % surfactant-1 solution was coated instead of 1600 ml of polyvinyl alcohol solution (II).

Ink Jet Recording Sheet Sample 3

Ink Jet Recording Sheet Sample 3 was prepared in the same manner as in Ink Jet Recording Sheet Sample 1, except that a mixture solution of 530 ml of polyvinyl alcohol solution (II) and 1070 ml of an aqueous 0.3 weight % surfactant-1 solution was coated instead of 1600 ml of polyvinyl alcohol solution (II).

Ink Jet Recording Sheet Sample 4

Ink Jet Recording Sheet Sample 4 was prepared in the same manner as in Ink Jet Recording Sheet Sample 1, except that a mixture solution of 400 ml of polyvinyl alcohol solution (II) and 1200 ml of an aqueous 0.3 weight % surfactant-1 solution was coated instead of 1600 ml of polyvinyl alcohol solution (II).

Ink Jet Recording Sheet Sample 5

Ink Jet Recording Sheet Sample 5 was prepared in the same manner as in Ink Jet Recording Sheet Sample 1, except that a mixture solution of 320 ml of polyvinyl alcohol solution (II) and 1280 ml of an aqueous 0.3 weight % surfactant-1 solution was coated instead of 1600 ml of polyvinyl alcohol solution (II).

Ink Jet Recording Sheet Sample 6

Ink Jet Recording Sheet Sample 6 was prepared in the same manner as in Ink Jet Recording Sheet Sample 2, except that 60 ml of an aqueous 2 weight % sodium tetraborate (as a hardener) solution were added to the mixture solution, dispersed for 30 minutes by means of a high-speed homogenizer, and the resulting dispersion was coated instead of the mixture solution.

Ink Jet Recording Sheet Sample 7

Ink Jet Recording Sheet Sample 7 was prepared in the same manner as in Ink Jet Recording Sheet Sample 3, except that 50 ml of an aqueous 2 weight % sodium tetraborate (as a hardener) solution were added to the mixture solution, dispersed for 30 minutes by means of a high-speed homogenizer, and the resulting dispersion was coated instead of the mixture solution.

Ink Jet Recording Sheet Sample 8

Ink Jet Recording Sheet Sample 8 was prepared in the same manner as in Ink Jet Recording Sheet Sample 4, except that 60 ml of an aqueous 2 weight % sodium tetraborate (as a hardener) solution were added to the mixture solution, dispersed for 30 minutes by means of a high-speed homogenizer, and the resulting dispersion was coated instead of the mixture solution.

Ink Jet Recording Sheet Sample 9

Ink Jet Recording Sheet Sample 9 was prepared in the same manner as in Ink Jet Recording Sheet Sample 5, except that 70 ml of an aqueous 2 weight % sodium tetraborate (as a hardener) solution were added to the mixture solution, dispersed for 30 minutes by means of a high-speed homogenizer, and the resulting dispersion was coated instead of the mixture solution.

The resulting samples obtained above were evaluated for the following items:

(1) Glossiness

Glossiness was measured at an angle of 60 degree employing a glossmeter, VGS-1001DP produced by Nihon Denshoku Kogyo Co., Ltd.

(2) Void Volume

Reversed thin lines were printed on Y and M image portions employing an on-demand type ink jet printer capable of controlling the ink jetting amount. The maximum ink amount jetted at which the printed line can be discriminated without ink oozing was defined as void volume.

(3) Ink Absorption

A color image is formed on the samples employing an ink jet printer MJ-5100C produced by Seiko Epson Co., Ltd., and an image having been supplied with a large amount of ink was evaluated according to the following criteria:

A: Neither fill-in in shadow portions due to ink oozing, nor blurring due to cracks observed.

B: Fill-in in shadow portions due to ink oozing, but no blurring due to cracks.

C: Fill-in in shadow portions due to ink oozing and blurring due to cracks observed, but formed images are discriminated.

D: Fill-in in shadow portions due to ink oozing, blurring due to cracks, and layer separation in formed image portions observed, and formed images can not be discriminated.

(4) Layer Forming Property

Layer forming property of the samples was evaluated according to the following criteria:

A: No cracks observed, and no layer separation observed when the surface layer was strongly rubbed with fingers under a relative humidity of 80%.

B: No cracks observed, and slight layer separation observed when the surface layer was strongly rubbed with fingers, but no layer separation in ordinary handling.

C: Fine cracks observed on the entire surface, but no layer separation observed when the samples were transported in the printer.

D: Layer separation observed, and layer separation easily occurred when the samples were transported in the printer.

The results are shown in Table 1.

TABLE 1

| Ink Jet Recording Sheet Sample No. | Glossiness (%) | Void Volume ($ml/m^2$) | Ink Absorption | Layer Forming Property |
|---|---|---|---|---|
| Sample 1 (Comp.) | 72 | 11 | C | B |
| Sample 2 (Comp.) | 42 | 14 | C | C |
| Sample 3* (Comp.) | Unmeasurable | Unmeasurable | Unmeasurable | D |
| Sample 4* (Comp.) | Unmeasurable | Unmeasurable | Unmeasurable | D |
| Sample 5* (Comp.) | Unmeasurable | Unmeasurable | Unmeasurable | D |
| Sample 6 (Inv.) | 66 | 15 | B | A |
| Sample 7 (Inv.) | 62 | 18 | A | A |
| Sample 8 (Inv.) | 60 | 22 | A | A |
| Sample 9 (Inv.) | 56 | 26 | A | B |

Comp.: Comparative, Inv.: Invention

*The void layers of Sample Nos. 3, 4 and 5 were separated from the support due to poor layer forming property and could not be evaluated.

Table 1 shows that, of ink jet recording sheet samples 1 to 5 containing no hardener, samples with a low polyvinyl alcohol content relative to the fine silica particle content lower the layer forming property, and samples (1 and 2) having a content ratio of silica to polyvinyl alcohol of 2 to 4 provide a relatively good layer forming property but are low in ink absorption due to small void volume, so that high quality images can not be obtained.

In contrast, inventive ink jet recording sheet samples (6 through 9) have an excellent layer forming property, and even inventive samples with a low polyvinyl alcohol content relative to the fine silica particle content provide high glossiness and excellent ink absorption while maintaining an excellent layer forming property.

Example 2

Ink jet recording sheet samples 11 through 19 were prepared in the same manner as in ink jet recording sheet samples 1 through 9 of Example 1, respectively, except that polyvinyl alcohol having an average polymerization degree of 700 and a saponification degree of 89 mol % was used instead of polyvinyl alcohol having an average polymerization degree of 1700 and a saponification degree of 90 mol %.

The resulting samples were evaluated in the same manner as in Example 1. The results are shown in Table 2.

TABLE 2

| Ink Jet Recording Sheet Sample No. | Glossiness (%) | Void Volume (ml/m$^2$) | Ink Absorption | Layer Forming Property |
|---|---|---|---|---|
| Sample 11 (Comp.) | 48 | 10 | D | C |
| Sample 12 (Comp.) | Unmeasurable | Unmeasurable | Unmeasurable | D |
| Sample 13 (Comp.) | Unmeasurable | Unmeasurable | Unmeasurable | D |
| Sample 14 (Comp.) | Unmeasurable | Unmeasurable | Unmeasurable | D |
| Sample 15 (Comp.) | Unmeasurable | Unmeasurable | Unmeasurable | D |
| Sample 16 (Inv.) | 54 | 14 | C | A |
| Sample 17 (Inv.) | 51 | 19 | A | A |
| Sample 18 (Inv.) | 45 | 22 | B | B |
| Sample 19 (Inv.) | 40 | 25 | B | B |

Comp.: Comparative, Inv.: Invention

Table 2 shows that, in ink jet recording sheet samples containing no hardener and containing a polyvinyl alcohol with a low polymerization degree, even samples (11 and 12) with a relatively high polyvinyl alcohol content relative to a fine silica particle content lower a layer forming property, resulting in poor quality, however, the use of a hardener improves a layer forming property, and provides substantially the same effects as Example 1.

Example 3

Ink jet recording sheet samples 21 through 29 were prepared in the same manner as in ink jet recording sheet samples 1 through 9 of Example 1, respectively, except that polyvinyl alcohol having an average polymerization degree of 3500 and a saponification degree of 88 mol % was used instead of polyvinyl alcohol having an average polymerization degree of 1700 and a saponification degree of 90 mol %. The resulting samples were evaluated in the same manner as in Example 1, and substantially the same effects as Example 1 were obtained.

Example 4

Ink jet recording sheet samples 36 through 39 were prepared in the same manner as in ink jet recording sheet samples 6 through 9 of Example 1, respectively, except that ethylene glycol diglycidyl ether as a hardener was used instead of sodium tetraborate.

The resulting samples were evaluated in the same manner as in Example 1. The results are shown in Table 3.

TABLE 3

| Ink Jet Recording Sheet Sample No. | Glossiness (%) | Void Volume (ml/m$^2$) | Ink Absorption | Layer Forming Property |
|---|---|---|---|---|
| Sample 36 (Inv.) | 60 | 13 | B | B |
| Sample 37 (Inv.) | 58 | 17 | B | B |
| Sample 38 (Inv.) | 52 | 21 | A | B |
| Sample 39 (Inv.) | 47 | 23 | A | B |

Inv.: Invention

Table 3 shows that ink jet recording sheet samples 36 through 39 containing ethylene glycol diglycidyl ether is lower in layer forming property than samples containing sodium tetraborate, but is higher in layer forming property and ink absorption than samples containing no hardener.

Example 5

Ink jet recording sheet samples 41 through 49 were prepared in the same manner as in ink jet recording sheet samples 1 through 9 of Example 1, respectively, except that glycerin was further added to the coating mixture solution to contain 0.5 g/m$^2$ of glycerin.

The resulting samples were evaluated in the same manner as in Example 1. The results are shown in Table 4.

TABLE 4

| Ink Jet Recording Sheet Sample No. | Glossiness (%) | Void Volume (ml/m$^2$) | Ink Absorption | Layer Forming Property |
|---|---|---|---|---|
| Sample 41 (Comp.) | 74 | 11 | C | B |
| Sample 42 (Comp.) | 46 | 14 | C | C |
| Sample 43 (Comp.) | Unmeasurable | Unmeasurable | Unmeasurable | D |
| Sample 44 (Comp.) | Unmeasurable | Unmeasurable | Unmeasurable | D |
| Sample 45 (Comp.) | Unmeasurable | Unmeasurable | Unmeasurable | D |
| Sample 46 (Inv.) | 72 | 14 | B | A |
| Sample 47 (Inv.) | 70 | 17 | A | A |
| Sample 48 (Inv.) | 68 | 21 | A | A |
| Sample 49 (Inv.) | 63 | 25 | A | A |

Comp.: Comparative, Inv.: Invention

Table 4 shows that inventive samples (46 through 49) containing glycerin further improve a layer forming property and glossiness.

What is claimed is:

1. An ink-jet recording sheet comprising a hydrophobic support, and provided thereon, a void layer containing fine inorganic particles in secondary order particle form in an amount of 1 to 30 g/m$^2$ and a hydrophilic binder in an amount of 0.2 to 10 g/m$^2$, the fine inorganic particles having an average secondary order particle size of 0.02 to 0.2 $\mu$m and the hydrophilic binder having been cross-linked by a hardener, wherein the dry thickness of the void layer is 15 to 50 μm and the content ratio by weight of the hydrophilic binder to the fine inorganic particles is 1:15 to 1:1.

2. The ink-jet recording sheet of claim 1, wherein the void layer contains the fine inorganic particles in an amount of 5 to 20 g/m$^2$ and the hydrophilic binder in an amount of 0.5 to 5 g/m$^2$.

3. The ink-jet recording sheet of claim 1, wherein the hydrophilic binder is a polyvinyl alcohol or a cation-modified polyvinyl alcohol.

4. The ink-jet recording sheet of claim 3, wherein the polyvinyl alcohol or cation-modified polyvinyl alcohol has an average polymerization degree of 1,000 to 4,000.

5. The ink-jet recording sheet of claim 3, wherein the saponification degree of the polyvinyl alcohol is 80 to 100 mol %, and the saponification degree of the cation-modified polyvinyl alcohol is 70 to 99 mol %.

6. The ink-jet recording sheet of claim 1, wherein the fine inorganic particles have an average primary order particle size of 0.003 to 0.05 μm.

7. The ink-jet recording sheet of claim 1, wherein the fine inorganic particles are silica particles having an average primary order particle size of 0.006 to 0.015 μm.

8. The ink-jet recording sheet of claim 1, wherein the hardener is boric acid or its salt or a polyepoxy compound.

9. The ink-jet recording sheet of claim 8, wherein the hardener is boric acid or its salt.

10. The ink-jet recording sheet of claim 1, wherein the void layer further contains a polyol with a molecular weight of not more than 300 having at least two hydroxy groups in the molecules.

11. The ink-jet recording sheet of claim 10, wherein the polyol content of the void layer is 0.01 to 2 g based on 1 g of the hydrophilic binder used.

12. The ink-jet recording sheet of claim 1, wherein the dry thickness of the void layer is 20 to 50 μm.

13. The ink-jet recording sheet of claim 1, wherein the void volume of the void layer is 13 to 30 ml/m$^2$.

14. The ink-jet recording sheet of claim 1, wherein the fine inorganic particles are flocculated.

15. The ink-jet recording sheet of claim 1, wherein the content ratio by weight of the hydrophilic binder to the fine inorganic particles is 1:10 to 1:2.

16. The ink-jet recording sheet of claim 15, wherein the void volume of the void layer is 13 to 30 ml/m$^2$;

the void layer contains the fine inorganic particles in an amount of 5 to 20 g/m$^2$ and the hydrophilic binder in an amount of 0.5 to 5 g/m$^2$; and the fine inorganic particles have an average primary order particle size of 0.003 to 0.05 μm.

17. The ink-jet recording sheet of claim 16, wherein the hydrophobic support is selected from a resin film or plate of a polyester resin, a diacetate resin, a triacetate resin, an acyl resin, a polycarbonate resin, a polyvinyl chloride resin, a polyimide resin, cellophane, celluloid or a glass plate.

18. The ink-jet recording sheet of claim 16, wherein the hydrophobic support is i) a paper having located on at least one surface, a polyolefin resin containing white pigment or ii) a polyethylene or a polyethylene terephthalate sheet containing white pigment.

19. The ink-jet recording sheet of claim 1, wherein the hydrophobic support is selected from a resin film or plate of a polyester resin, a diacetate resin, a triacetate resin, an acyl resin, a polycarbonate resin, a polyvinyl chloride resin, a polyimide resin, cellophane, celluloid or a glass plate.

20. The ink-jet recording sheet of claim 1, wherein the hydrophobic support is i) a paper having located on at least one surface, a polyolefin resin containing white pigment or ii) a polyethylene or a polyethylene terephthalate sheet containing white pigment.

* * * * *